US006425140B1

(12) United States Patent
Vitches

(10) Patent No.: US 6,425,140 B1
(45) Date of Patent: Jul. 30, 2002

(54) PAIR OF UNDERPANTS, PARTICULARLY A PAIR OF BOXER SHORTS

(75) Inventor: Vladimir Vitches, Aspelt (LU)

(73) Assignee: Odda Finance Internationale S.A., Luxembourg (LU)

( * ) Notice: Subject to any disclaimer, the term of this patent is extended or adjusted under 35 U.S.C. 154(b) by 0 days.

(21) Appl. No.: 09/901,140

(22) Filed: Jul. 10, 2001

(51) Int. Cl.[7] ..... A41B 9/02
(52) U.S. Cl. ..... 2/403; 2/400
(58) Field of Search ..... 2/400, 402, 403, 2/401, 405, 404, 227, 234, 228, 238, 73, 406, 408, 69, 79, 78.1–78.3; 450/94, 99–106, 120, 122–128; 604/385.01, 385.09, 385.19; 602/67–71, 73

(56) References Cited

U.S. PATENT DOCUMENTS

| | | | | |
|---|---|---|---|---|
| 2,757,379 A | 8/1956 | Stone et al. | ..... | 2/43 |
| 3,844,282 A | 10/1974 | King | ..... | 128/159 |
| 4,377,008 A | 3/1983 | Jung | ..... | 2/403 |

FOREIGN PATENT DOCUMENTS

| | | |
|---|---|---|
| GB | 529742 | 11/1940 |

*Primary Examiner*—Gloria M. Hale
(74) *Attorney, Agent, or Firm*—Morrison & Foerster LLP

(57) ABSTRACT

A pair of underpants include two pieces of flexible material that are attached to the front of the underpants. The attached pieces are superimposed on each other and cover a slot that can act as the flies. The edges of the attached pieces which are furthest from the waistband are slanted with respect thereto in opposite directions and intersect, forming a re-entrant angle, in the vicinity of the opposite end of the slot from the waistband.

20 Claims, 6 Drawing Sheets

PAIR OF UNDERPANTS, PARTICULARLY A PAIR OF BOXER SHORTS

TECHNICAL FIELD OF THE INVENTION

The present, invention relates to underpants, particularly boxer shorts or similar garments, in which the body—which is that between the waistband and the legs—is provided, at the front, with an elongate slot whose direction is at least approximately perpendicular to the waistband of said underpants, this slot being able to act flies.

BACKGROUND OF THE INVENTION

Such underpants, which are principally intended for men and are described for example in documents U.S. Pat. No. 1, 661, 072 and U.S. Pat. No. 2, 822, 807 have the disadvantage that said slot tends to fall open, and they cannot therefore fulfill their function of comfortably enveloping the anatomy of the men wearing them. Such a disadvantage is exacerbated the tighter the fit of the underpants and the more flexible the fabric thereof.

To overcome this disadvantage, one idea has been to keep said slot closed, e.g. by means of press-studs (see for example document U.S. Pat. NO. 2, 459, 043). However, in the latter case such press-studs make the underpants uncomfortable to wear.

In light of the above, most close-fitting boxer shorts made of modern materials consisting of elastic fibers of very small diameter (of the order of microns) have no flies, which is obviously contrary to masculine anatomy and complicates the task of the wearer when answering a call of nature.

It is an object of the present invention to overcome these disadvantages.

SUMMARY OF THE INVENTION

To this end, according to the invention, the pair of underpants, particularly a pair of boxer shorts or other such garment, the body of which is provided, at the front, with an elongate slot whose direction is at least approximately perpendicular to the waistband of the underpants, this slot being able to act as the flies, is noteworthy in that:

- two pieces of flexible material are attached to the front of the underpants, the attached pieces being superimposed on each other and covering the slot;
- the attached pieces are fastened to the front of the underpants by lines of stitches whose general directions run traversely to the waistband on either side of the slot and at a distance from it; and
- those edges of the attached pieces which are furthest from the waistband are slanted with respect thereto in opposite directions and intersect, forming a re-entrant angle, in the vicinity of the opposite end of the slot from the waistband.

The present invention thus provides a pair of underpants in which the flies remain spontaneously closed for the comfort and modesty of the man wearing them, the flies being equally accessible to right-handed and left-handed persons, for their intentional opening, by the introduction of a hand into the re-entrant angle and through the slot.

The body of the underpants in accordance with one embodiment of the present invention preferably comprises two component pieces assembled by lines of stitches, the first of the component pieces at least partially forming the front, while the second forms at least the back and sides of the body.

These underpants therefore have no seam down the back, making them very comfortable to wear.

On the other hand, it is advantageous in the making of these underpants, for the first component piece to be made up of two elements assembled by a line of stitches continuing on from the slot, and the body to comprise a third component piece in the crotch of the underpants.

In a preferred embodiment, the first component piece is mostly covered by the attached pieces and the attached pieces are fastened to the of the underpants by lines of stitches assembling the first and second component pieces.

To further enhance the comfort procured by the underpants according to the invention, the underpants comprise an internal bag as a support for the scrotum, the bag being attached to the front of the body and being provided with a slot opposite that of the body. This prevents undesirable swinging of the scrotum and excessive tension at the groin. Furthermore, such an internal bag assists cleanliness.

The internal support bag and the front of the body are preferably attached to each other by stitches along the superimposed edges of their respective slots.

The underpants in accordance with the present invention may also comprise an internal piece that covers the end, furthest from the waistband, of the slot of the body, the internal covering piece being attached to the front of the body by stitches at a distance from the slot, in order to have an action such as to tend to close the slot without preventing it from being opened intentionally.

In addition, in order to ensure that the waistband does not slide down when the wearer is crouching—causing the shirt to spill out of the pants—it is advantageous that, in the underpants according to the invention, the front of said waistband is lower than its back.

For esthetic purposes, each of said attached pieces may have a color which is different from the color of the other attached piece, and from the color of said underpants. Such different colors may be in opposition or indeed associated tone for tone.

BRIEF DESCRIPTION OF THE DRAWINGS

The figures of the appended drawing will show clearly how the invention can be carried out. In these figures, identical references denote similar parts.

DESCRIPTION OF THE PREFERRED EMBODIMENTS

The men's boxer shorts 1 shown in these figures and forming an example of an embodiment of the shorts according to the present invention comprise a body 2 limited at its upper end by a waistband 3 and at its lower end by short legs 4 and 5.

Figure 1:
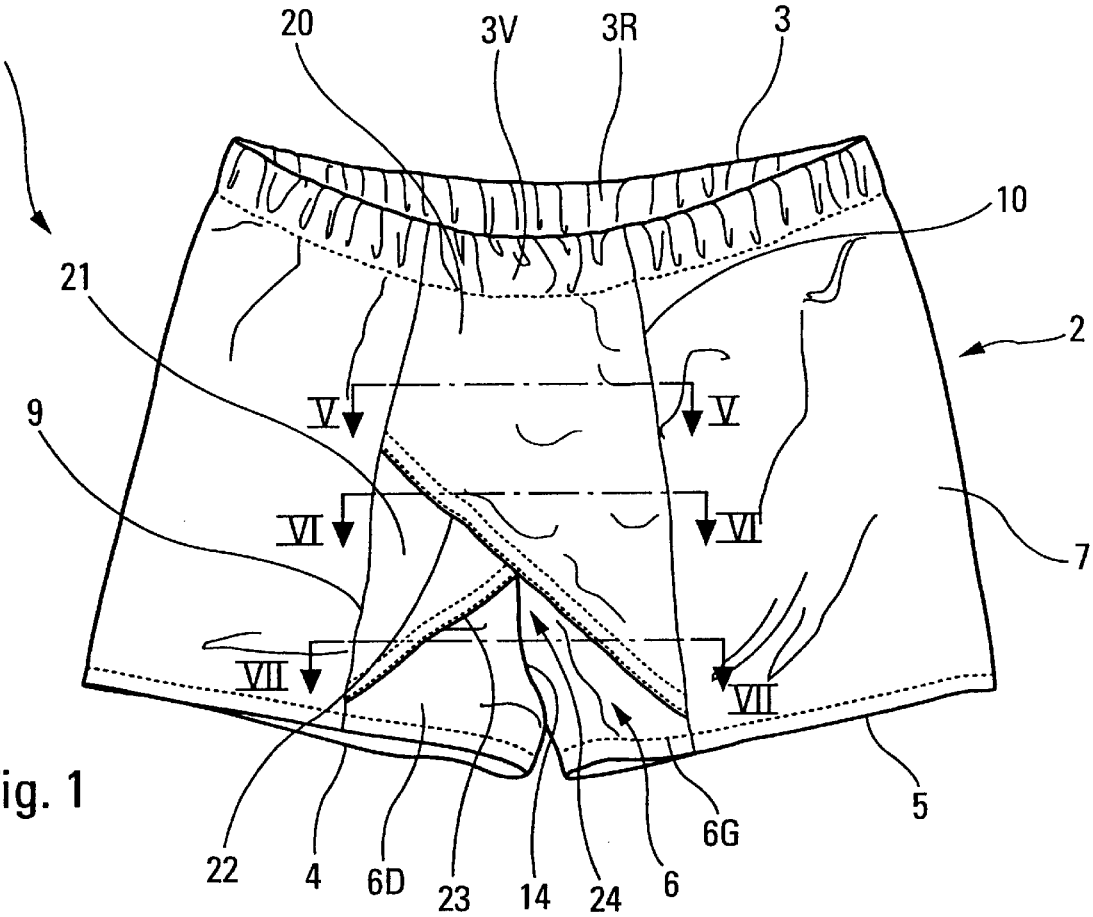
FIG. 1 shows, from the outside, the front of a pair of boxer shorts in accordance with the present invention, these shorts being laid flat.
Figure 5:
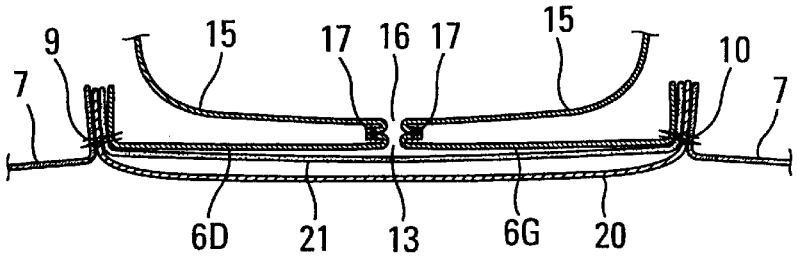
FIGS. 5, 6 and 7 are partial sections through the front of the shorts shown in FIGS. 1–4, taken on V—V, VI—VI and VII—VII as marked in FIG. 1.
Figure 6:
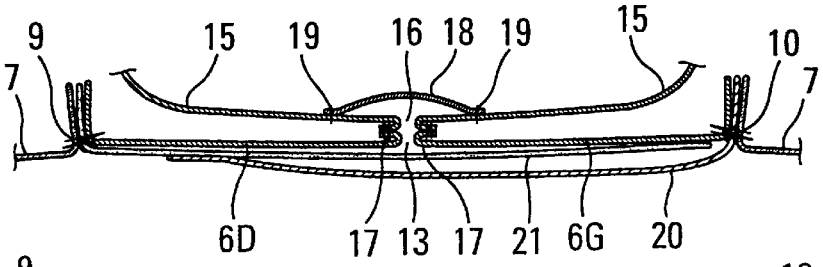
Figure 7:
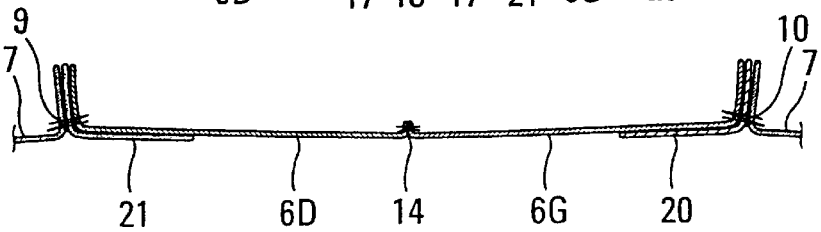
Figure 2:
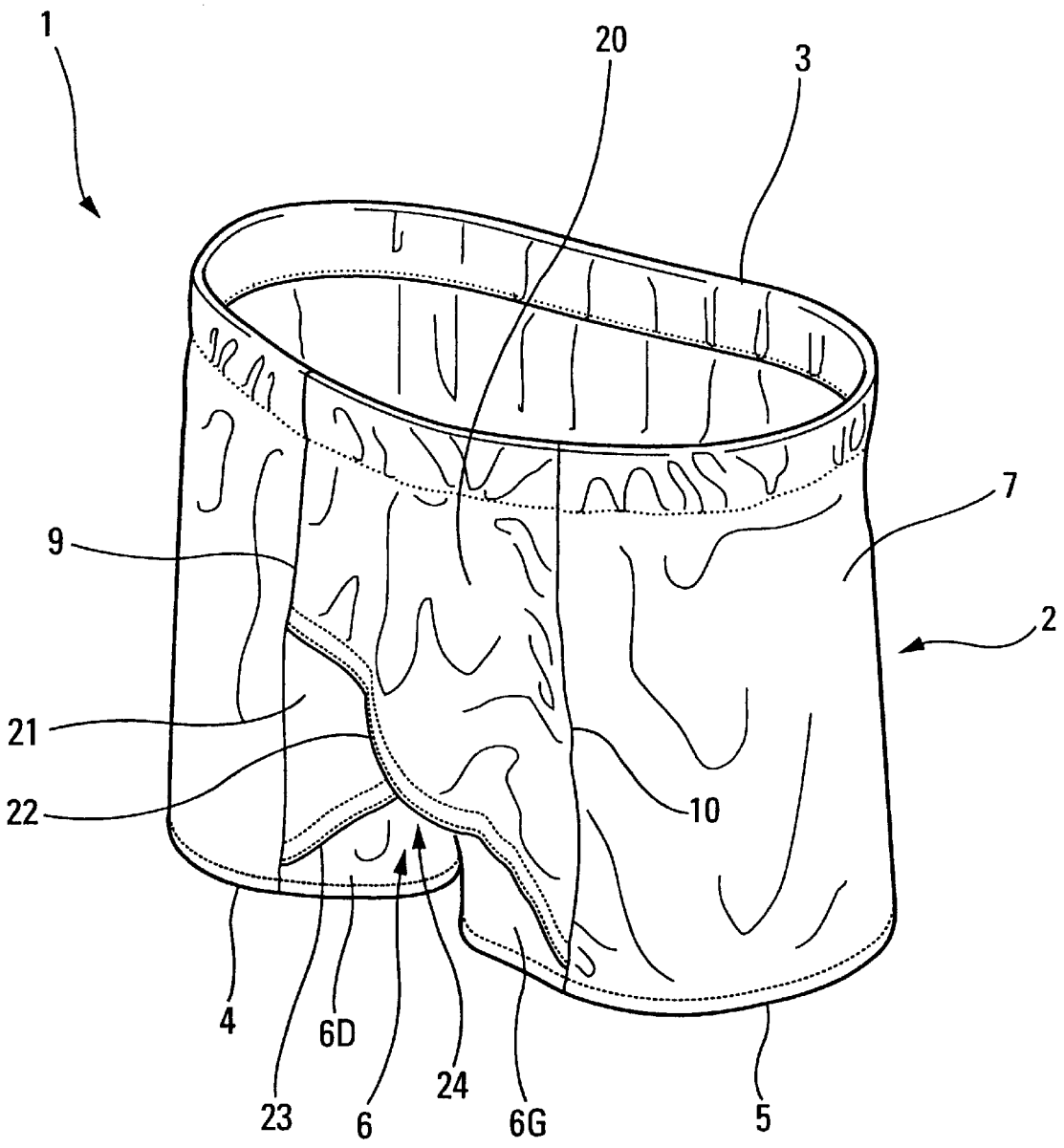
FIG. 2 is a perspective view, from the front and from above, of the shorts shown in FIG. 1.
Figure 3:
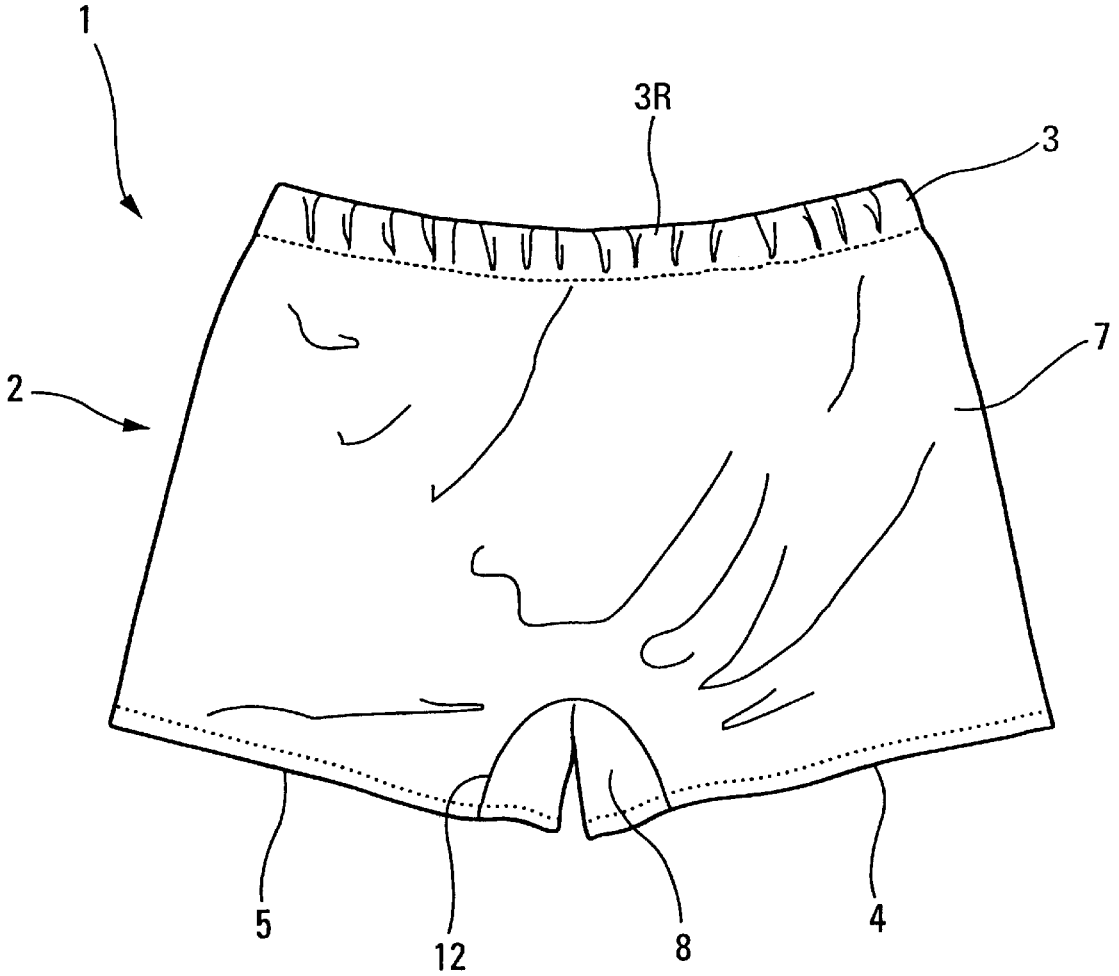
FIG. 3 shows, from the outside, the back of the shorts shown in FIGS. 1 and 2, laid flat.
Figure 4:
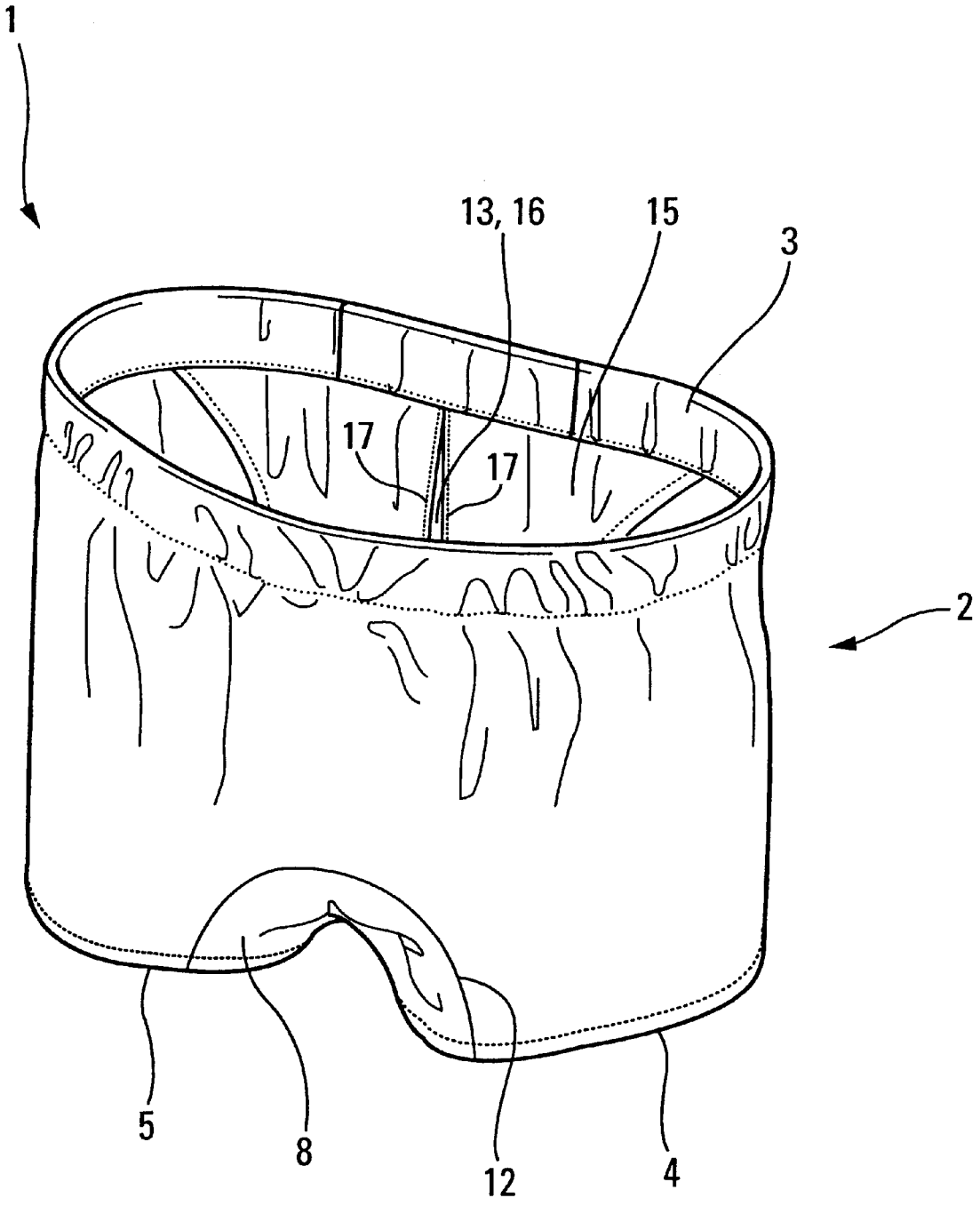
FIG. 4 is a perspective view, from behind and from above, of the shorts shown in FIGS. 1–3.
Figure 8:
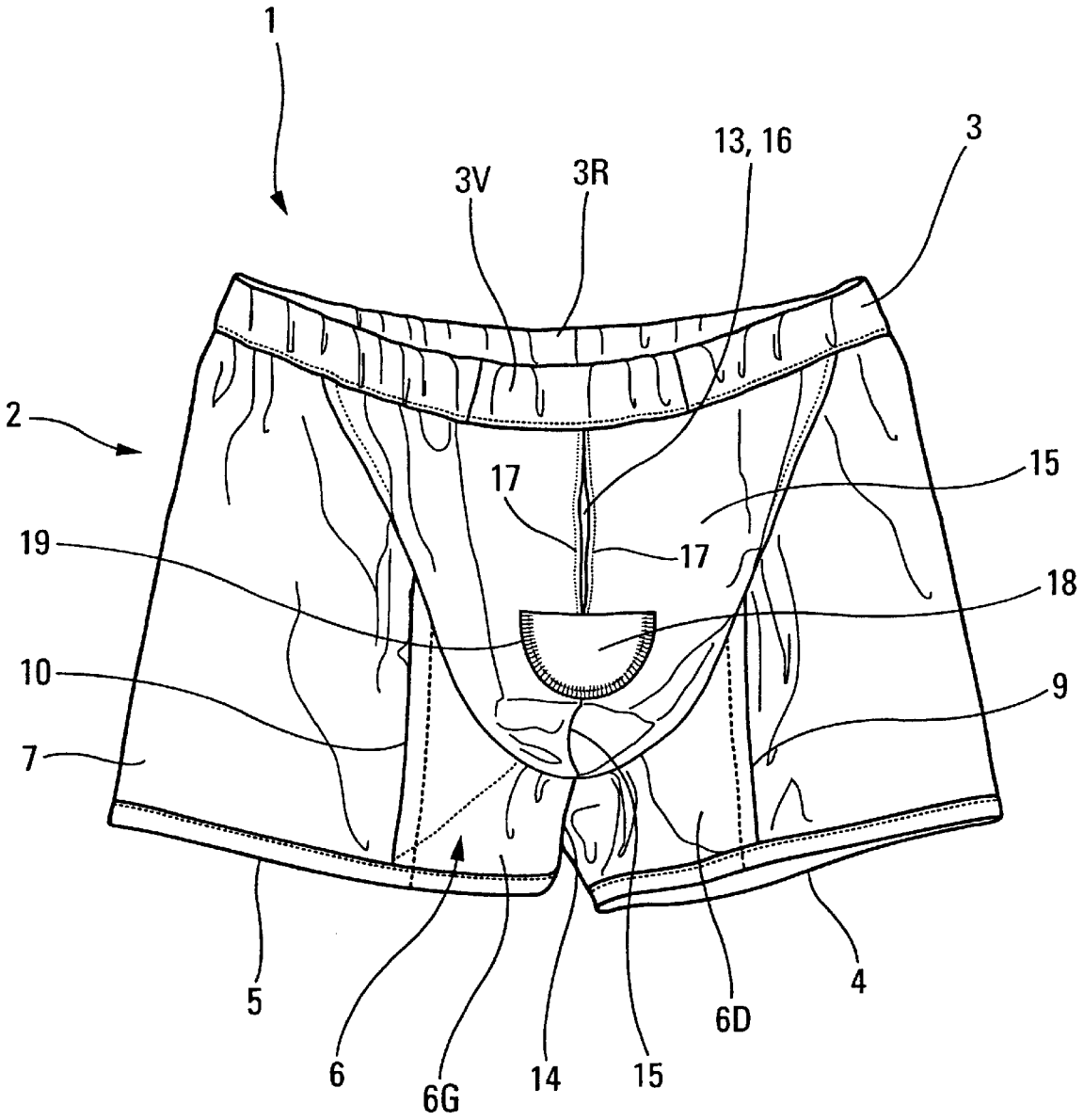
FIG. 8 shows, from the inside, the front of the shorts shown in FIGS. 1–7, the shorts being turned inside out and laid flat.
Figure 9:
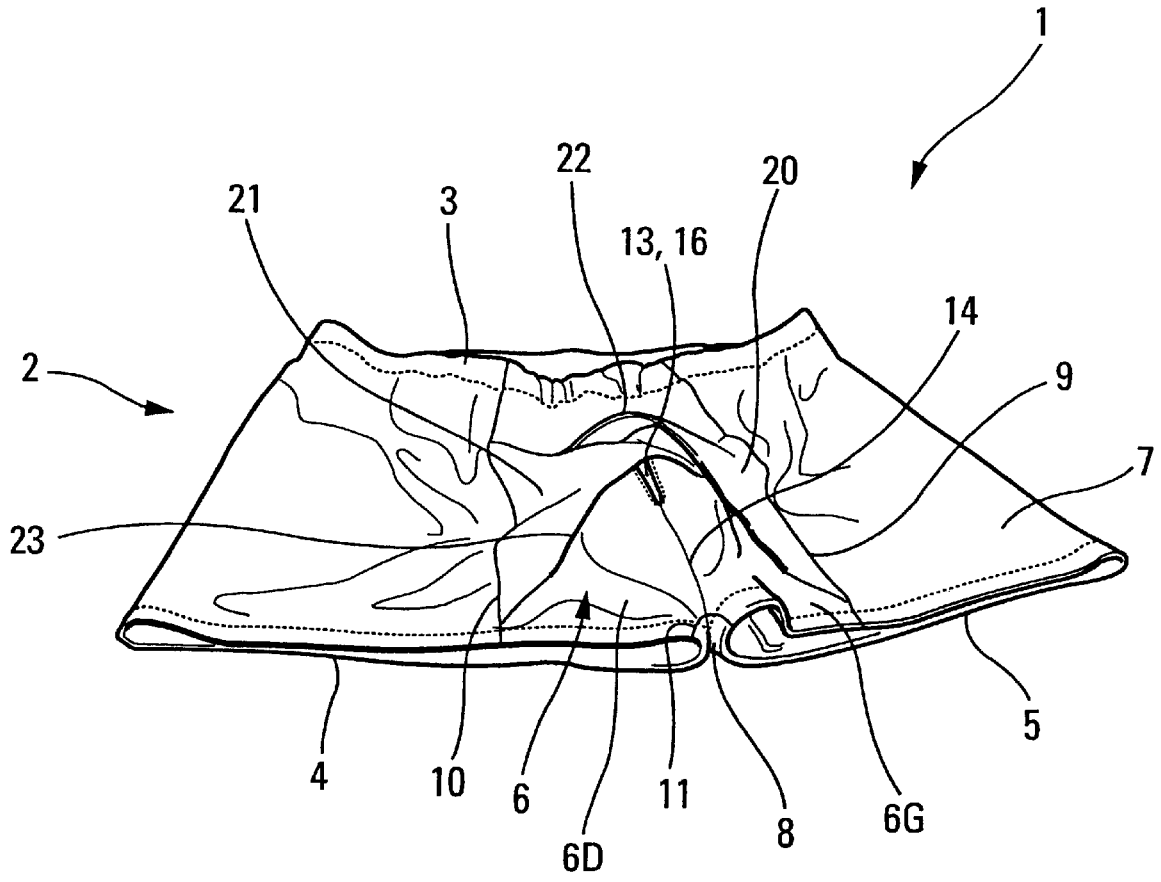
FIG. 9 is a perspective view, from the front and from below, of the shorts shown in FIGS. 1–8, this view illustrating the outside of the front of said shorts, when the shorts are laid flat.

As is particularly visible in FIGS. 1 and 8, the front 3V of the waistband 3 is lower than its back 3R.

The boxer shorts 1 comprise three component pieces, namely a first piece 6 forming the central part of the front of said shorts, a second piece 7 forming the whole back and sides of the shorts, as well as the side portions of said front, and a third piece 8 forming the crotch of said shorts.

The first and second component pieces 6 and 7 are joined together by lines of stitches 9 and 10 at the front of the shorts 1, the lines of stitches 9 and 10 being separated from each other with their general directions running transversely with respect to the waistband 2. The third component piece 8 is assembled to said first and second component pieces 6 and 7 by lines of stitches 11 and 12.

The first component piece 6 is made up of two elements 6D and 6G, between which is formed an elongate central slot 13, the direction of which is at least approximately perpendicular to said waistband 3 and which can act as the flies of the shorts 1. This slot 13 is halfway between the lines of stitches 9 and 10 and is at a distance from both of these. The two elements 6D and 6G are in addition assembled to each other, at their upper end, by the waistband 3 and at their lower end by a line of stitches 14.

The boxer shorts 1 also include an internal bag 15 for supporting the scrotum of the man wearing them, this internal bag 15 being attached to the front of the shorts being provided with a slot 16 opposite the slot 13 of the first component part 6. The internal bag 15 and the piece 6 are joined together by lines of stitches 17 along the superimposed edges of the slots 13 and 16. The boxer shorts thus have, at the front, a slot formed by the superimposition of the slots 13 and 16.

At the opposite end of the slot 13, 16 from the waistband 2, the boxer shorts 1 have an internal piece 18 to cover this end of this slot 13, 16, this covering piece 18 being joined to the first component piece 6 by lines of stitches 19 at a distance from said slot in order to have an action such as to tend to close the slot 13, 16 without however preventing it from being opened intentionally.

It is a feature of the present invention that the shorts 1 comprise two pieces of flexible material 20 and 21 attached to the first piece 6 in such a way that they overlap and cover the slot 13, 16. These attached pieces 20 and 21 are fastened to the boxer shorts by the lines of stitched 9 and 10 fastening the first and second component pieces 6 and 7. In addition, the respective edges 22 and 23 of the attached pieces 20 and 21 furthest from the waistband 3 are slanted with respect to the latter in opposite directions, and intersect in the vicinity of the lower end of the slot 13, 16, forming a re-entrant angle 24.

It will therefore be readily understood that the attached pieces 20 and 21 spontaneously close off the slot 13, 16, but that the slot is easily accessible from the exterior by passing a hand under the re-entrant angle 24.

The component pieces 6, 7 and 8 and the attached pieces 20 and 21 may be of identical color. However, for a fanciful esthetic effect, it is also possible to choose for each of the different pieces 6, 7, 8, 20 and 21 any color which, together with the color or colors of the other pieces, would give the desired effect. In particular, it is possible to choose, for the component pieces 6, 7 and 8, one identical color, and, for each of said attached pieces, a color differing both from the color of the other attached piece and from the color of said component pieces 6, 7 and 8.

What is claimed is:

1. A pair of underpants, having a body provided at a front with an elongated slot whose direction is at least approximately perpendicular to a waistband of the underpants, the slot configured as a fly, the underpants comprising:

two pieces of flexible material attached to the front of the underpants, the attached pieces superimposed on each other and covering the slot, wherein the attached pieces are fastened to the front of the underpants by lines of stitches in a direction transverse to the waistband on either side of the slot and at a distance from the slot, and wherein edges of the attached pieces furthest from the waistband are slanted with respect thereto in opposite directions and intersect, forming an angle at approximately an opposite end of the slot from the waistband.

2. The pair of underpants as claimed in claim 1, in which the body comprises first and second component pieces assembled by lines of stitches, the first of the component pieces at least partially forming a front, and the second component piece forming at least a back and sides of the body.

3. The pair of underpants as claimed in claim 2, in which the first component piece includes two elements assembled by a line of stitches continuing on from the slot.

4. The pair of underpants as claimed in claim 2, in which the body comprises a third component piece in a crotch area of the underpants.

5. The pair of underpants as claimed in claim 2, in which the first component piece is substantially covered by the attached pieces and the attached pieces are fastened to the front of the underpants by lines of stitches assembling the first and second component pieces.

6. The pair of underpants as claimed in claim 1, further comprising an internal bag to support a user's scrotum, the bag attached to the front of the body and provided with slot located opposite the body.

7. The pair of underpants as claimed in claim 6, in which the internal support bag and the front of the body are attached to each other by stitches along superimposed edges of respective slots.

8. The pair of underpants as claimed in claim 1, further comprising an internal piece to cover an end furthest from the waistband of the slot of the body, the internal covering piece attached to the front of the body by stitches at a distance from the slot, the external piece preventing the slot from unintentional opening.

9. The pair of underpants as claimed in claim 1, in which the front of the waistband is lower than a back.

10. The pair of underpants as claimed in claim 1, in which each of the attached pieces has a color which is different from the color of the other attached piece, and from the color of the underpants.

11. A pair of underpants, having a body provided at a front with a slot which substantially perpendicular to a waistband of the underpants, comprising:

two pieces of flexible material attached to the front of the underpants, the attached pieces provided to at least partially cover the slot, wherein the attached pieces are fastened to the front of the underpants on either side of the slot, and wherein edges of the attached pieces furthest from the waistband are slanted with respect to the waistband in opposite directions and intersect.

12. The pair of underpants as claimed in claim 11, in which the body comprises first and second component pieces , the first of the component pieces at least partially forming a front, and the second component piece forming at least a back and sides of the body.

13. The pair of underpants as claimed in claim 12, in which the first component piece includes two elements continuing on from the slot.

14. The pair of underpants as claimed in claim 12, in which the body comprises a third component piece in a crotch area of the underpants.

15. The pair of underpants as claimed in claim 12, in which the first component piece is substantially covered by the attached pieces.

16. The pair of underpants as claimed in claim 11, further comprising an internal bag to support a user's scrotum, the bag attached to the front of the body and provided with a slot located opposite the body.

17. The pair of underpants as claimed in claim 16, in which the internal support bag and the front of the body are attached to each other along superimposed edges of respective slots.

18. The pair of underpants as claimed in claim 11, further comprising an internal piece to cover an end furthest from the waistband of the slot of the body, the internal covering piece attached to the front of the body at a distance from the slot, the external piece preventing the slot from unintentional opening.

19. The pair of underpants as claimed in claim 11, in which the front of the waistband is lower than a back.

20. The pair of underpants as claimed in claim 11, in which each of the attached pieces has a color which is different from the color of the other attached piece, and from the color of the underpants.

* * * * *